US009440330B2

(12) United States Patent
Bukach

(10) Patent No.: US 9,440,330 B2
(45) Date of Patent: Sep. 13, 2016

(54) SHOT BLAST CLEANING WHEEL BLADE AND BLADE AND WHEEL COMBINATION

(71) Applicant: Astech Alloy Steel Technologies, Inc., Vassar, MI (US)

(72) Inventor: Alan R. Bukach, Vassar, MI (US)

(73) Assignee: Astech Alloy Steel Technologies, Inc., Vassar, MI (US)

( * ) Notice: Subject to any disclaimer, the term of this patent is extended or adjusted under 35 U.S.C. 154(b) by 179 days.

(21) Appl. No.: 14/148,819

(22) Filed: Jan. 7, 2014

(65) Prior Publication Data

US 2015/0190900 A1 Jul. 9, 2015

(51) Int. Cl.
*B24C 5/06* (2006.01)

(52) U.S. Cl.
CPC *B24C 5/062* (2013.01); *B24C 5/06* (2013.01)

(58) Field of Classification Search
CPC ..... B24C 5/06; B24C 5/062
USPC ..... 451/95, 97, 98, 38
See application file for complete search history.

(56) References Cited

U.S. PATENT DOCUMENTS 2,295,926 A * 9/1942 Boesger ..... B24C 5/06 451/95
3,444,651 A * 5/1969 Geisseler ..... B24C 5/062 451/97
3,872,624 A 3/1975 Ramaswamy
4,395,851 A 8/1983 Watts
4,447,993 A * 5/1984 Laido ..... B24C 5/06 451/102
4,751,798 A 6/1988 McDade
5,205,085 A 4/1993 Urakami
5,476,412 A * 12/1995 Stoltz ..... B24C 5/062 451/75
5,584,748 A * 12/1996 Flynn ..... B24C 5/062 451/91
5,759,091 A * 6/1998 MacMillan ..... B24C 5/062 415/115
6,447,378 B1 * 9/2002 Hoff ..... B24C 5/062 451/95
6,981,910 B1 * 1/2006 Goff ..... B24C 5/062 451/91
7,585,207 B2 * 9/2009 Barriger ..... B24C 5/062 451/95
8,043,141 B1 * 10/2011 Goff ..... B24C 5/062 451/38
8,550,881 B2 * 10/2013 Loutzenheiser ..... B24C 5/062 451/95
8,920,217 B2 * 12/2014 Panzenhagen ..... B24C 5/06 451/97
2008/0076333 A1 * 3/2008 Krause ..... B24C 5/062 451/94
2009/0149117 A1 * 6/2009 Barriger ..... B24C 5/062 451/97

* cited by examiner

*Primary Examiner* — Eileen Morgan
(74) *Attorney, Agent, or Firm* — Young Basile Hanlon & MacFarlane, P.C.

(57) ABSTRACT

An improved shot blasting blade is disclosed with an attachment portion designed to slide into a radial slot in a shot blasting wheel. The blade has rails that contactingly ride on a top surface of the wheel just outside the slot, and two sets of opposed runners that extend into the slot and contact the top inner surface of the slot.

20 Claims, 4 Drawing Sheets

SHOT BLAST CLEANING WHEEL BLADE AND BLADE AND WHEEL COMBINATION

FIELD OF THE DISCLOSURE

This invention relates to shot blast equipment and more particularly to shot blast wheels with removable blades radially disposed thereon.

BACKGROUND OF THE DISCLOSURE

Shot blasting is a common technique to change surface characteristics of a variety of different parts. A shot blasting wheel can propel shot or small spheres of hard material to impact and smooth a rough surface, roughen a smooth surface, shape a surface, or remove surface contaminants. Shot blasting can be achieved by a wheel and blade assembly accelerating shot to a relatively high velocity towards the material surface of an object or group of objects to be treated. It is typical to configure equipment such that shot material is introduced into the center of a rotating wheel having a plurality of radially disposed blades mounted thereon. The shot is accelerated by the blades attached to the spinning wheel, and can be directed toward an opening in a control cage where the shot may exit to contact the objects being treated. Wheel blasting is often referred to as airless blasting, as no fluid propellant is used.

Because of the abrasive quality of the shot and the high speed at which the wheels and blades are turned, blades wear out and require frequent replacement. Removable blades have been developed to allow a user to replace blades individually. A variety of designs of blade and wheel combinations have been utilized in an attempt to efficiently direct shot within a shot blasting machine.

SUMMARY OF THE DISCLOSURE

The present disclosure provides improvements to shot blasting blades, including improvements that make the blades more easily removed and installed without compromising safety or strength, and others that can reduce wear on the blades and wheel. The blades disclosed herein can reduce wear on critical wheel and blade surfaces, such as the wheel surfaces proximate to blade receiving slots, and blade surfaces proximate to the same receiving slots when installed. Furthermore, the blades disclosed can be utilized with wheels having different blade receiving slot configurations.

In one embodiment, a removably attachable blade comprises two side surfaces, a top connected and extending along the two side surfaces, and a blade attachment portion which, when installed, extends along a wheel radius. The blade attachment portion can comprise a rail extending perpendicular to the side surfaces and a plurality of runners, wherein the runners are configured to contact an inner surface of a blade receiving slot defined in the centrifugal blasting wheel and the bottom edge is configured to contact an outer wheel surface when the blade is in the attached position.

In another embodiment, a shot blasting wheel assembly adapted for directing shot through centrifugal action is disclosed. The assembly comprises an annular wheel and a plurality of blades removably attachable to the wheel. The wheel can comprise substantially planar blade mounting surfaces that extends radially from an inner perimeter to an outer perimeter and a plurality of radially extending blade receiving slots defined in the blade mounting surface, wherein the blade receiving slots have an interior width larger than the width measure at the blade mounting surface. Each blade can comprise a large area blade and an integrated attachment portion having opposing runners with bottom edge surfaces. The runners contact an inner surface of the blade receiver and the bottom edge surfaces contact an outer wheel surface when the blade is in an attached position.

In yet another embodiment, blades for a rotatable shot blasting wheel of the type having upwardly sloped, radial blade retaining slots with open tops defined by opposed radial flanges are disclosed. The blade comprises a blade body having opposite sides, a top flange, and an integral blade attachment portion. The blade attachment portion extends along the bottom of the body and comprises an upper, radially extending rail set extending substantially the full radial length of the blade body, a first set of opposed runners projecting laterally from the blade retaining portion at or near the radially-innermost end of the blade, and a second set of opposed runners projecting laterally from the blade retaining portion forwardly of the first set of runners. The runners are offset relative to the height of the blade to achieve a cam fit with a blade receiving slot of radially decreasing cross sectional dimension, such that a portion of the blade proximate to the blade receiving slot is held between the rail set and the first and second set of runners through a trapping or wedging action.

Variations in these and other aspects of the disclosure will be described in additional detail hereafter.

BRIEF DESCRIPTION OF THE DRAWINGS

The various features, advantages and other uses of the present invention will become more apparent by referring to the following detailed description and drawings in which.

DETAILED DESCRIPTION

Figure 1:
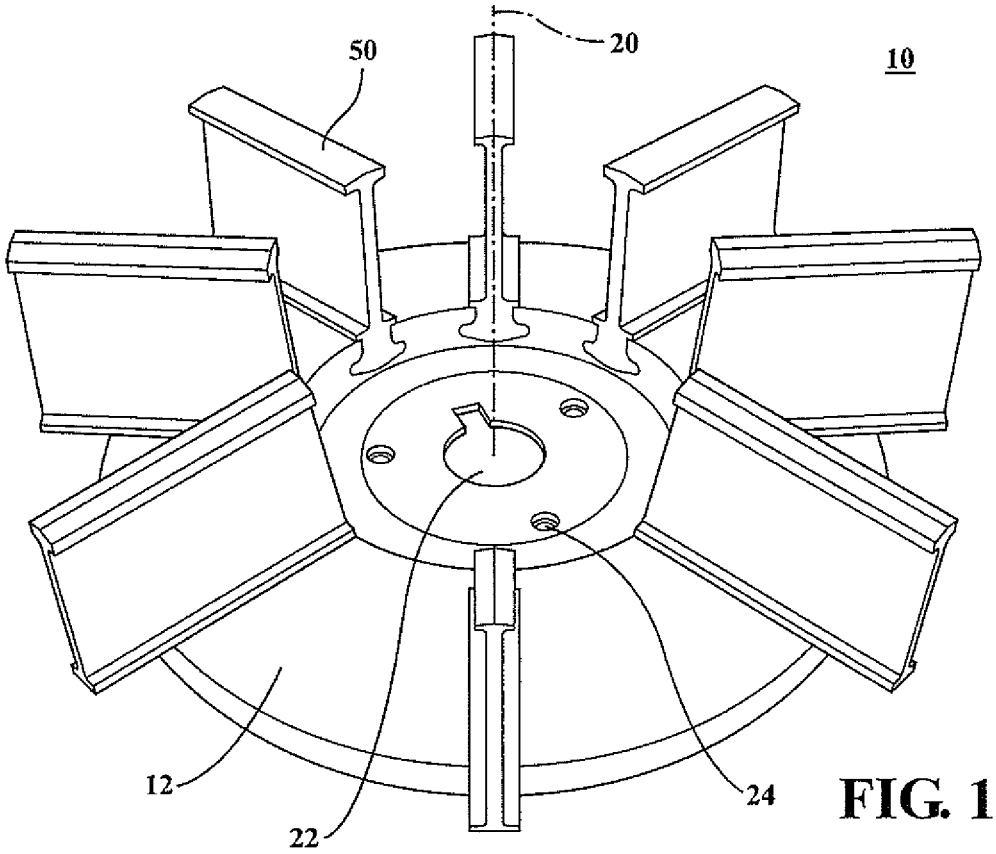
FIG. 1 is a perspective view of a wheel and blade shot blasting assembly with radial slide-in blades.

Referring first to FIG. 1, there is shown a wheel shot blasting assembly 10 comprising wheel 12 and a plurality of blades 50. The shot blasting assembly 10 is designed such that it can be rotated about center axis 20. Center axis aperture 22 can be defined in wheel 12 to receive a shaft (not shown) that is driven under power to produce the rotation of the assembly. Additional mounting apertures 24 may be included in wheel 12. It is typical for such assemblies to be rotated at approximately 2800 revolutions per minute (rpm). In one example, center axis aperture 22 can receive a shaft that is attached to a direct driven electric motor. The shot blasting assembly 10 can be incorporated within a shot blast cage (not shown) to contain and direct shot to the subject part or parts to be treated. Shot can be introduced to the blasting assembly 10 at or near the center of the wheel, and upon contact and impact with blades 50 the shot is accelerated in a radial direction towards the outside of the assembly, where it ultimately comes into contact with and treat the surface of the subject part or parts. Blades 50 must be securely held in the wheel 12 during operation to ensure an efficient and safe process.

Figure 2:
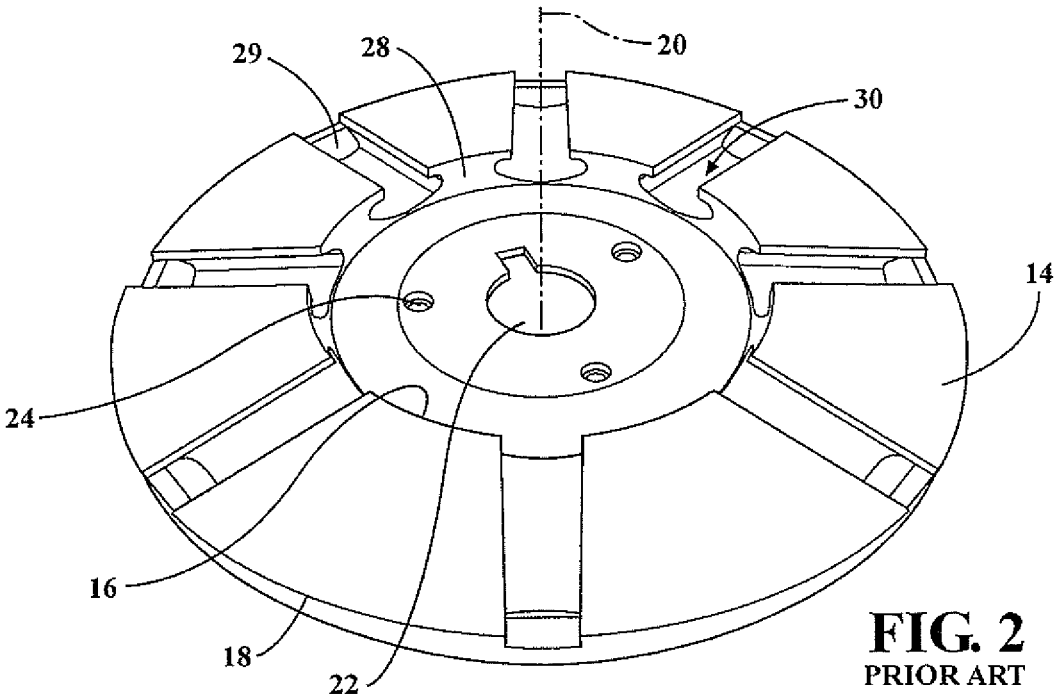
FIG. 2 PRIOR ART
FIG. 2 is a perspective view of a prior art wheel useable in the wheel shot blasting assembly.

FIG. 2 shows one embodiment of wheel 12 usable in shot blasting assembly 10. Wheel 12 includes a plurality of blade mounting surfaces 14 that extend from an inner perimeter 16 to an outer perimeter 18. Inner perimeter 16 and outer perimeter 18 are elliptical and concentric about axis 20. Blade mounting surfaces 14 are substantially planar and orientated substantially perpendicular to axis 20. Blade mounting surfaces 14 oppose and are spaced away from a bottom surface 26 of wheel 12. Blade mounting surfaces 14 can be separated by blade receiving slots 30 of wheel 12. In the embodiment shown in FIG. 2, blade receiving slots 30 comprise a plurality of grooves or channels defined in wheel 12. Each blade retaining slot 30 is configured to retain one blade during operation of the shot blasting assembly. Wheel 12 is shown as having a total of eight blade retaining portions, but other numbers are contemplated. Blade receiving slots 30 can extend from inner surface 28, located at inner perimeter 16, in a radially outward direction. The blade receiving slots 30 can extend to outer surface 29, which is located between inner surface 28 and the outer perimeter 18. Outer surface 29 can be parallel to inner surface 28 or orientated at an angle as shown in FIG. 2.

Figure 3:
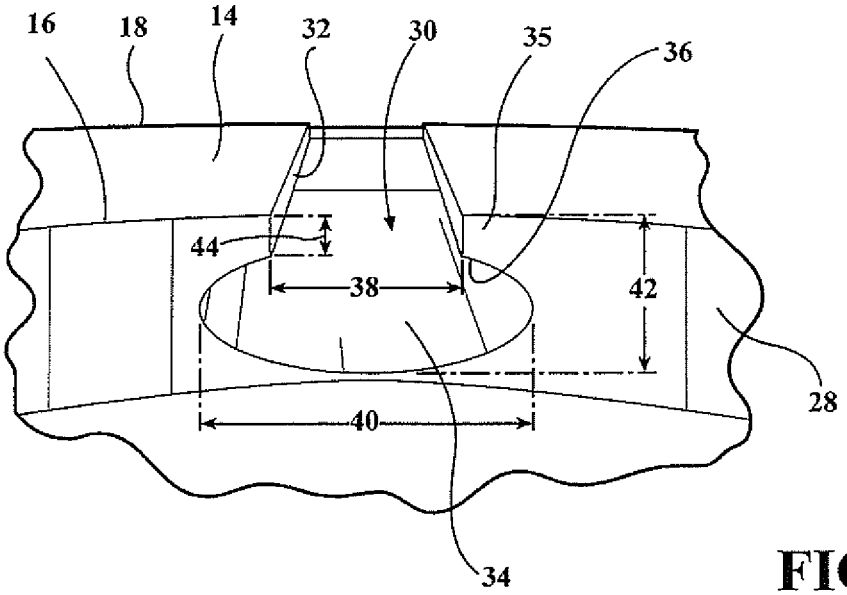
FIG. 3 PRIOR ART
FIG. 3 is a partial perspective view of the prior art wheel of FIG. 2 showing the blade receiving slot of the wheel.

FIG. 3 shows blade receiving slot 30 with more detail, as viewed looking radially outward from a location proximate to axis 20. Blade receiving slot 30 in the embodiments of FIGS. 2 and 3 have a substantially elliptical concave bottom, a pair of spaced upper flanges 35 that include an interior surface that mirrors the concave bottom at each side of the slot opening, and opposite facing sides proximate the blade mounting surface 14. As a result, receiving slot 30 defines lower retaining surface 34, upper retaining surfaces 36, and side retaining surfaces 32. Lower retaining surface 34 is the lower elliptical surface and upper retaining surfaces 36 are the interior surface of the wheel slot flanges 35 that mirror the elliptical shape of the lower retaining surface 34. Side retaining surfaces 32 oppose each other and border the blade mounting surface 14 at an approximately 90 degrees.

Slot width 40, slot depth 42, slot surface width 38, and flange height 44 can be defined as labeled in FIG. 3. Slot width 40 is the maximum horizontal width of the elliptical portion of the blade receiving slot 30 at a given cross section, where slot height 42 is the height of the bottom of the elliptical portion to the blade retaining surface 14. Slot surface width 38 is the distance between side retaining surfaces 32 at a specific cross section of the wheel. Flange height 44 is the thickness of the flanges 35, defined as the distance from retaining surface 14 to the upper retaining surface 36. In the embodiments described herein, the slot width 40 is larger than the receiving surface width 38 at a given cross section of receiving slot 30. Receiving slots 30 are shown as tapering in both a width direction and height direction, where the width and height of slots 30 decreases as distance from the center of the wheel increases. Thus, the retaining width 40, height 42, and surface width 38 all decrease in a radially outward direction. The flange height 44 increases at cross sections at farther radial distances, as the distance from the retaining surface 14 to the upper retaining surface increases. It is, however, contemplated that blade receiving slots 30 can be of a fixed cross section throughout, with unchanging cross-sectional dimensions.

Figure 4:
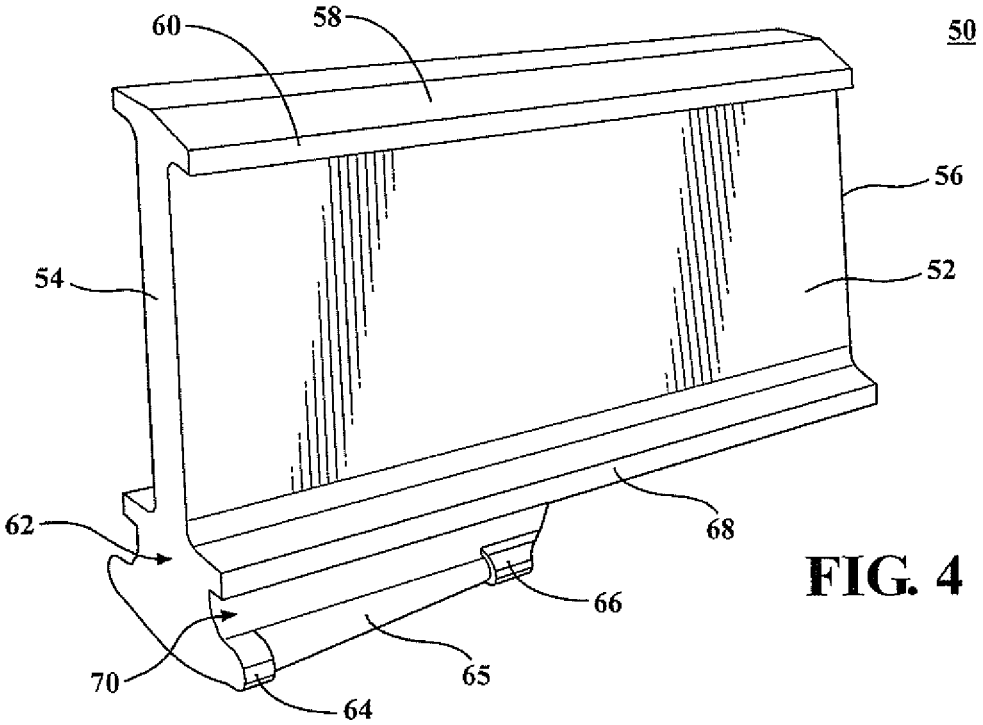
FIG. 4 is a perspective view of a blade that is attachable to the wheel of FIGS. 2 and 3.
Figure 5:
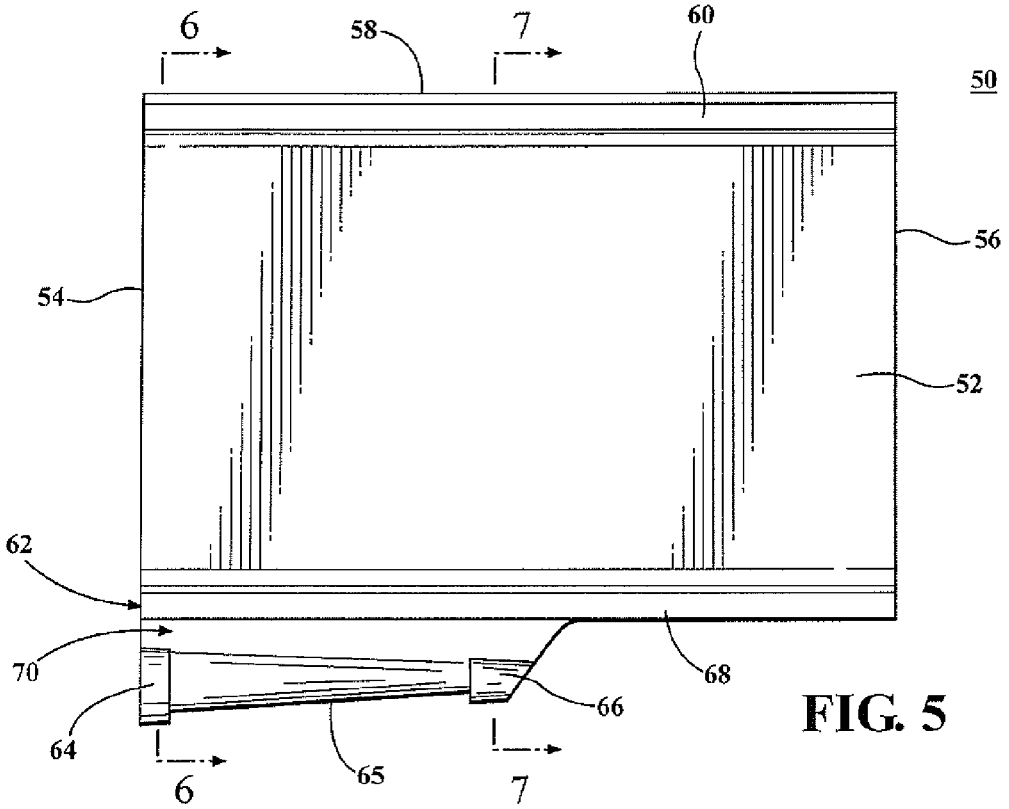
FIG. 5 is a side view of the blade of FIG. 4.

Turning now to FIGS. 4 and 5, blade 50 will be further described. Blade 50 comprises sides 52 that extend from inner blade surface 54 to outer blade surface 56. Sides 52 can be substantially parallel and planar as shown in the Figures, or sides 52 can be curved or bent with respect to each other or a radially outward direction. That is, blades 50 can be purely radial or can be curved or bent like vanes on a fan or pinwheel. Sides 52 can be spaced apart at a constant distance as shown, but it is also contemplated that the distance between sides 52 can vary, creating a tapered blade width.

Blade 50 further comprises top flange 58 that extends along the top of blade 50 from inner blade surface 54 to outer blade surface 56, and top flange 58 is wider than the distance between sides 52. Top flange 58 is longitudinally ridged. Alternatively, top flange 58 can be flat. Top flange 58 can be designed to be a certain shape based upon clearance between the blade 50 and shot blast cage, when the blade 50 is installed. Top edges 60 can overhang and extend past sides 52 in a lateral direction, perpendicular to sides 52 proximate to top edge 60.

Located opposite top flange 58 and formed integrally with blade 50 is blade attachment portion 62. Blade attachment portion 62 allows the blade 50 to be removably attached to wheel 12 by sliding portion 62 into blade retaining slot 30. Blade attachment portion 62 comprises opposed, outwardly projecting longitudinal rails 68. Blade 50 further comprises longitudinally spaced-apart sets 64 and 66 of opposed runners. Runners 64 and 66 are spaced below the rails 68, such that a channel 70 is defined between the runners and rails. Runners 64 and 66 do not extend the entire length of the attachment portion 62; rather they are disposed near the inner and outer ends of an extension of the attachment portion 62 as shown. Rib 65 spans between the inner runners 64 and outer runners 66. Blade attachment portion 62 can be symmetrical such that inner and outer runners 64 and 66 of each side of the blade are similarly shaped, sized, and positioned as the opposing side runners.

Figure 6:
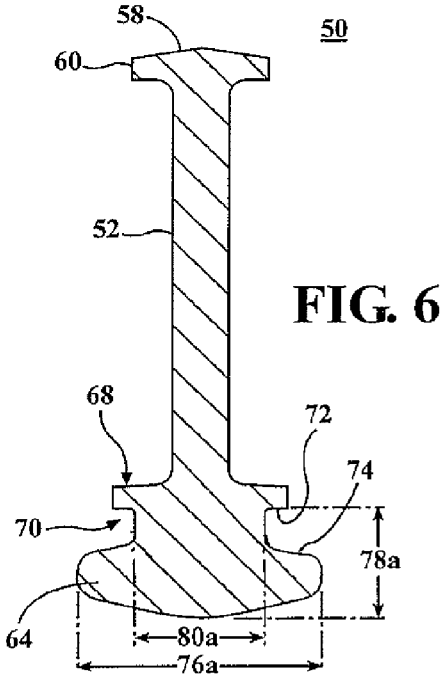
FIG. 6 is a sectional view of the blade of FIG. 5 as viewed along the line 6-6.
Figure 7:
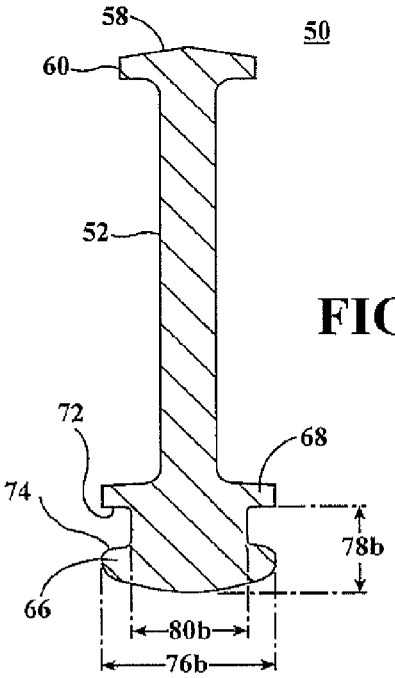
FIG. 7 is a sectional view of the blade of FIG. 5 as viewed along the line 7-7.

FIGS. 6 and 7 are sectional views of blade 50, taken at the inner and outer runners, respectfully. As shown in FIGS. 6 and 7, channel 70 is defined between bottom rail surfaces 72 and runner surfaces 74. Runner widths 76*a* and 76*b*, attachment heights 78*a* and 78*b*, and attachment widths 80*a* and 80*b* are also shown. As evident in the Figures, runner width, attachment heights, and attachment widths can vary at different points of blade 50. For example, all three of these dimensions at a cross section at the outer runners 66 are less than the equivalent dimensions at inner runners 64. Thus, blade attachment portion 62 can be said to taper both laterally and vertically in a radial direction. These dimensions can be chosen to allow proper fit of the blade attachment portion 62 into the receiving slot 30 for installation and removal, as discussed further below. A distal radial end of the attachment portion 62 can have an angled surface that is orientated similar to outer surface 29 of wheel 12.

Figure 8:
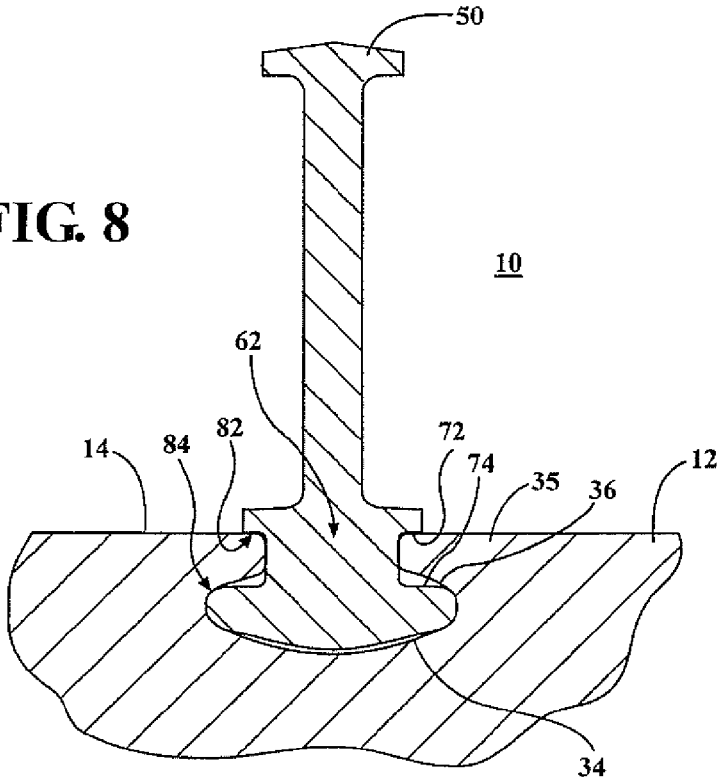
FIG. 8 is a partial sectional view of the blade of FIGS. 4 and 5 in an attached position with the wheel of FIGS. 2 and 3.

With reference to FIGS. 1 and 8, the attachment of blade 50 to wheel 12 is further detailed. Blade 50 can be installed by sliding the blade 50 radially outward such that the blade attachment portion 62 engages blade retaining slot 30. Blade 50 can be slid along the blade retaining surface wherein the runners 64 and 66 are positioned within the blade retaining slot and the rails 68 sit on top of the blade retaining surface. The runners 64 and 66 and rails 86 trap the wheel slot flanges 35 between them. This trapping action eliminates the need to for the blade to conform to, or even contact, the bottom of the retaining slot 30.

In the fully attached position, blade 50 is retained by wheel 12 through the contact of the bottom rail surfaces 72 with blade mounting surface 14, and the contact of runner surfaces 74 with upper retaining surface 36. The bottom surface 72 of rail 68 contacts blade mounting surface 14 at top contact point 82 at a given cross section, as shown in FIG. 8. Depending on the particular structure of the bottom rail surface 72 and blade mounting surface 14, top contact point 82 can be several contact points, or a contact plane if both surfaces are substantially parallel. Runner surface 74 contacts the upper retaining surface 36 at bottom contact point 84. Runner widths 76*a* and 76*b* are sized smaller than retaining width 40, attachment heights 78*a* and 78*b* are sized smaller than retaining height 42, and retaining widths 80*a* and 80*b* are sized smaller than retaining surface width 38 such that the blade 50 can be positioned with blade attachment 62 within the retaining portion 30 of wheel 12.

In the fully attached position, blade 50 is held in place vertically by the contact of bottom rail surface 72 of rail 68 and retaining surface 14 and the contact between runner surface 74 and upper retaining surface 36. Retaining slot flanges 35 of wheel 12 are "sandwiched" in channel 70 between the rails and runners. Furthermore, the blade can be retained from further movement in a radially outward direction through contact of an end of blade attachment 62 and outer surface 29 of wheel 12, or through frictional forces from the contacting surfaces of blade 50 and wheel 12. Additional ways in further securing or locking blade 50 to wheel 12 can also be accomplished.

As evident from the above description and FIG. 8, the blade attachment portion 62 does not contact the concave bottom retaining surface 34, nor does the shape of the bottom of blade attachment portion 62 match the shape of lower retaining surface 34. This allows for a blade of given configurations to be utilized with wheels having different retaining portion cross sectional shapes. It also compensates for variances in the surfaces or tolerances of wheel 12 and blade 50.

Figure 9:
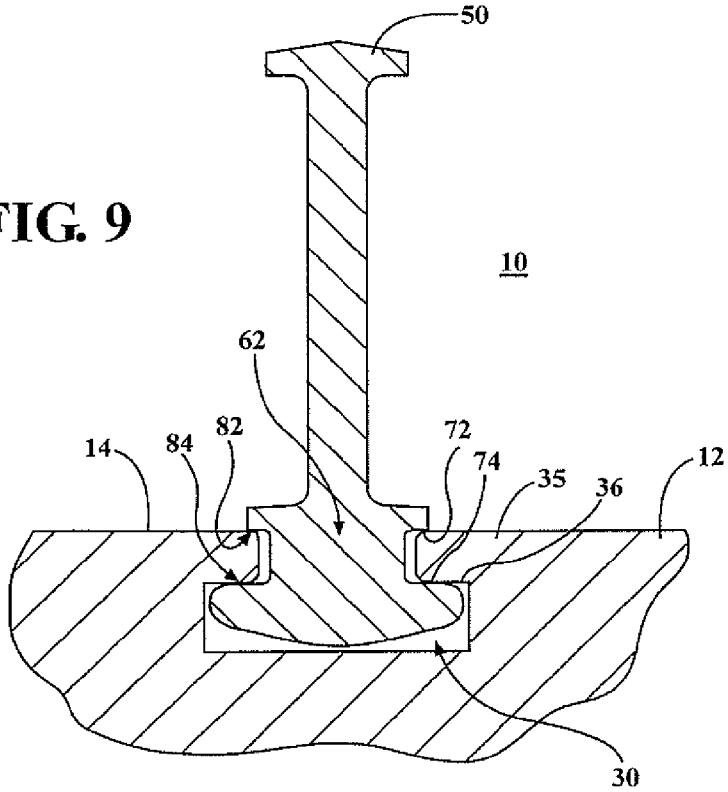
FIG. 9 is a partial sectional view of the blade of FIGS. 4 and 5 in an attached position with a wheel with an alternate blade receiving slot.

FIG. 9 illustrates another example of wheel 12 with differently shaped blade retaining portion 30. In the example of FIG. 9, the retaining portion 30 has a rectangular cross section, but still has a retaining width larger than a retaining surface with like previous embodiments. Blade 50 is attachable in the similar manner of sliding the blade attachment portion 62 into the blade receiving slots 30 from the inside end of the slot. Top contact point 82 can remain where the blade contacts the wheel 12. Because of the different shaped top surface 36, bottom contact point 84 might be at a slightly different location on the runners.

Since blades 50 and wheel 12 contact shot material at high speeds, it is to be appreciated that both blades 50 and wheel 12 are comprised of a wear-resistant material. As an example, blade 50 can be created through an investment casting process from a 15/3 chrome iron with tolerances of approximately of 5/1000s of an inch. Other suitable materials are contemplated for forming the blades, as well as through different processes such as machining and other types of casting. Blade 50 can also be heat treated to reach a Rockwell scale of C 58 to further harden the steel, providing further wear resistance when in use.

The design of both the blades 50 and wheel 12 help alleviate some of the problems due to the wear from the contact with the abrasive shot material. By having a simple slide-in blade, blades can be replaced as they show signs of significant wear, at different times than replacing the wheel. For example, under a particular pattern of use the blades may wear out every week, while the wheel stays functional for longer periods of time. Another advantage of the embodiments disclosed herein is that the blade 50 can protect portions of wheel 12 proximate to the blade receiving slots 30 from abrasion and wear. By incorporating rail 68 to allow the blade 50 to contact both the upper receiving surface 36 and the blade retaining surface 14, blade receiving slots 30 are provided additional protection from wear. Rail 68 can extend past the edge of blade retaining surface 14 as shown in the Figures. Where other designs allow shot to wear down the blade retaining surface 14 area near blade receiving slots 30, rail 68 protects the inside of blade receiving slots 30 and the retaining surface 14 in close proximity to the openings of blade receiving slots 30. This can increase wheel life, and prevent abrasive wear near the blade receiving slots such that wheel 12 can safely and effectively retain blades 50 for a longer period of time. The added overlap of rail 68 can also aid in the removal and attachment processes, as it can prevent shot material from collecting and blocking portions of receiving slots 30 as well as prevent blade 50 to seize to the wheel at points within the receiving slots 30.

The above-described embodiments have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A blade removably attachable to a centrifugal blasting wheel, the blade comprising:

a body of metal with two opposed side surfaces; and a blade attachment portion integral with said body and including a set of parallel, opposed rails extending laterally outwardly from the side surfaces and along a portion of a length of the blade, and a plurality of laterally outwardly extending runners below and generally parallel to said rails, the runners having contact surfaces configured to engage an inner surface of a blade receiving slot in a centrifugal blasting wheel, the slot opening up to a horizontal top surface of the wheel, and the rails being configured to contact upwardly facing portions of the top surface of the wheel adjacent the blade receiving slot when the blade is in an attached position in the blade receiving slot, such that the blade attachment portion is configured to receive a portion of the wheel proximate to the blade receiving slot between each rail and the runners;

wherein the plurality of runners includes an inner runner and an outer runner that are separate along the length of the blade, the inner and outer runners each have a height and a width, and the blade attachment portion tapers vertically and laterally, such that the height and the width of the inner runner are greater than the height and the width of the outer runner.

2. The blade of claim 1 wherein the blade is removably attached to the wheel through sliding of the blade with respect to the wheel in a wheel radial direction.

3. The blade of claim 1 wherein the two side surfaces are parallel to each other.

4. The blade of claim 1 wherein the two side surfaces are substantially planar and extend in a constant direction.

5. The blade of claim 1 wherein the body comprises a top edge that extends beyond each of the two side surfaces.

6. The blade of claim 1 wherein the inner runner projects laterally from the blade retaining portion at or near a radially-innermost end of the body, and the outer runner projects laterally from the blade retaining portion forwardly of the inner runner.

7. The blade of claim 6 wherein a cross sectional area of the outer runner is smaller than a cross sectional area of the inner runner.

8. The blade of claim 1 wherein the blade attachment portion tapers vertically, such that the inner runner and the outer runner are spaced at different heights relative to the rails to achieve a cam fit with the blade receiving slot of radially decreasing cross sectional dimension, such that the portion of the wheel proximate to the blade receiving slot is held between the rails and the runners through a trapping action.

9. The blade of claim 1 wherein the rails and the runners define two opposed channels that are each configured to receive a flange of the wheel therein, each flange forming the inner surface of the blade receiving slot to be engaged by the runners and forming the upwardly facing surface to be contacted by one of the rails.

10. A shot blasting wheel assembly adapted for directing shot through centrifugal action, the assembly comprising:

an annular wheel comprising substantially planar blade mounting surfaces that face upward and that extend radially from an inner perimeter to an outer perimeter and a plurality of radially extending blade receiving slots defined between the blade mounting surfaces, wherein the blade receiving slots have an interior width larger than an opening width thereof measured at the blade mounting surface; and a plurality of blades removably attachable to the wheel in the plurality of blade receiving slots, wherein each blade comprises a blade attachment portion comprising rails that extend laterally from side surfaces of the blade and extend along a portion of a length of the blade and a plurality of runners that extend generally parallel to said rails, and when each blade is in an attached position in one of the slots, the rails each contact one of the blade mounting surfaces adjacent the blade receiving slot and the runners contact an inner surface of the blade receiving slot with a portion of the wheel proximate to the slot being received between each rail and the runners, such that the blade is held in place vertically by the runners contacting the inner surface of the blade receiving slot and the rails contacting the blade mounting surfaces; and wherein each of the runners has a height and a width, and the blade attachment portion tapers moving radially outward, such that the height and the width of an inner runner of the plurality of runners are greater than the height and the width of an outer runner of the plurality of runners wherein the inner runner and outer runner are separate along the length of the blade.

11. The wheel assembly of claim 10 wherein the plurality of blade receiving slots each have a substantially elliptical cross section.

12. The wheel assembly of claim 10 wherein the plurality of blade receiving slots each have a substantially rectangular cross section.

13. The wheel assembly of claim 10 wherein the interior width and the blade mounting surface width of the blade receiving slots decrease as a function of radial distance from a center axis of the wheel.

14. The wheel assembly of claim 10 wherein the wheel includes an outer surface at a radially distal end of the blade receiving slot, the outer surface to prevent the blades from moving in a radially outward direction.

15. The wheel assembly of claim 10 wherein the plurality of radially extending blade receiving slots comprises eight receiving slots spaced equally around the wheel.

16. The wheel assembly of claim 10 wherein an upper opening of each slot is defined by two opposed flanges of the wheel, and the rails and runners of each blade define two opposed channels that are each configured to receive one of the flanges therein, each flange forming the inner surface of the blade receiving slot to be contacted by one of the rails and forming one of the blade mounting surfaces to be contacted by one of the rails.

17. The shot blasting wheel assembly of claim 10, wherein each of the runners has an attachment height that is a vertical distance between bottoms of the rails and a bottom of the runner, and the blade attachment portion tapers, such that the attachment height of the inner runner is greater than the attachment height of the outer runner.

18. A blade for a rotatable shot blasting wheel of the type having upwardly sloped, radial blade retaining slots with open tops defined by opposed radial flanges, the blade comprising:

a blade body having opposite sides, a top flange, and an integral blade attachment portion, said blade attachment portion extending along a bottom of the blade body and comprises an upper, radially extending rail along substantially a full length of the blade body, a first set of opposed runners projecting laterally from the blade retaining portion at or near a radially-innermost end of the blade, and a second set of opposed runners projecting laterally from the blade retaining portion radially forwardly of the first set of runners wherein the first set of runners and the second set of runners are separate along the length of the blade body, wherein the blade attachment portion tapers moving radially with the runners being spaced at different heights relative to the rails to achieve a wedged fit with a blade receiving slot of radially decreasing cross sectional dimension, such that a portion of the wheel proximate to the blade receiving slot is trapped and held between the rail and the first and second set of runners to hold the blade in place vertically.

19. The blade of claim 18 wherein the rail and runners define a channel configured to receive a flange of the wheel therein, the flange forming the portion of the wheel that is trapped and held between the rail and the first and second set of runners.

20. The blade of claim 18, wherein the first set of runners has a first height and a first width, the second set of runners has a second height and a second width, and the blade attachment portion tapers, such that the first height and the first width are, respectively, greater than the second height and the second width.

* * * * *